US007149416B2

(12) United States Patent
Nawrot et al.

(10) Patent No.: US 7,149,416 B2
(45) Date of Patent: Dec. 12, 2006

(54) CLOTHES DRYER HEATER WITH AIR FLOW INCREASING DEVICE ADJACENT THE HEATING ELEMENT

(75) Inventors: Thomas Nawrot, Berlin (DE); Bert Peters, Brieselang (DE); Andreas Ziemann, Berlin (DE)

(73) Assignee: BSH Bosch and Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/868,700

(22) Filed: Jun. 14, 2004

(65) Prior Publication Data

US 2005/0047763 A1 Mar. 3, 2005

(30) Foreign Application Priority Data

Jun. 12, 2003 (DE) ..... 103 26 550

(51) Int. Cl.
*F24D 5/10* (2006.01)

(52) U.S. Cl. ..... 392/350; 219/536; 34/596

(58) Field of Classification Search ..... 392/350, 392/360–369, 379–385, 491–492; 219/536–537; 68/20; 34/596
See application file for complete search history.

(56) References Cited

U.S. PATENT DOCUMENTS

| | | | | | |
|---|---|---|---|---|---|
| 427,574 | A | * | 5/1890 | Howard | 392/350 |
| 1,517,738 | A | * | 12/1924 | Loker | 392/347 |
| 2,537,821 | A | * | 1/1951 | Blanche | 392/374 |
| 3,219,797 | A | * | 11/1965 | Brady | 392/384 |
| 3,691,649 | A | * | 9/1972 | Pigors | 34/523 |
| 4,019,023 | A | * | 4/1977 | Marzonie et al. | 219/400 |
| 4,459,466 | A | * | 7/1984 | Nakagawa et al. | 392/307 |
| 4,960,976 | A | * | 10/1990 | Insley | 392/485 |
| 5,134,270 | A | * | 7/1992 | Bragg et al. | 219/532 |
| 5,329,098 | A | * | 7/1994 | Howard et al. | 219/532 |
| 6,141,495 | A | * | 10/2000 | Roth | 392/363 |

FOREIGN PATENT DOCUMENTS

| | | | |
|---|---|---|---|
| DE | 19651294 | | 6/1998 |
| GB | 496509 | * | 12/1938 |
| GB | 2320877 | | 7/1998 |
| JP | 4-82594 | * | 3/1992 |

* cited by examiner

*Primary Examiner*—Thor S. Campbell
(74) *Attorney, Agent, or Firm*—Craig J. Loest; Russell W. Wamock

(57) ABSTRACT

A heater for a washer-dryer includes a duct in which heating elements for heating the air flowing through the duct are disposed. A device for increasing the airflow in the area of a heating element is provided in the duct to improve the transportation of heat away from the heating element. The airflow device can be one or more projections on a wall of the duct extending into the duct and can be disposed upstream of the heating element with respect to a flow direction of the air, adjacent the heating element, and/or downstream of the heating element.

6 Claims, 3 Drawing Sheets

CLOTHES DRYER HEATER WITH AIR FLOW INCREASING DEVICE ADJACENT THE HEATING ELEMENT

BACKGROUND OF THE INVENTION

Field of the Invention

Washer-dryers normally have an electrical heating device for heating the processed air in a duct section upstream of the drying area. A large number of electrical heating elements are disposed one behind the other in the flow direction in the duct section for such a purpose. The heating elements are, normally, in the form of helical heating filaments, which are disposed transversely with respect to the flow direction in the duct section, as is described, by way of example, in U.S. Pat. No. 5,329,098 to Howard et al.

Such a configuration has the disadvantage that there is a high concentration of heat in the area of the heating filaments, which heat must be transferred to the processed air and must be dissipated through the processed air, while it is essential to prevent overheating of the heating elements. This is particularly problematic in the case of heating filaments that are disposed downstream within the heater because the processed air has already been preheated by the upstream heating filaments, so that the temperature difference between the processed air and the downstream heating filaments has been decreased, so that the surface temperature of the heating filaments that are disposed on the downstream side is higher than that of the upstream heating filaments.

SUMMARY OF THE INVENTION

It is accordingly an object of the invention to provide a heater for a washer-dryer that overcomes the hereinafore-mentioned disadvantages of the heretofore-known devices of this general type and that ensures reliable operation of the heater and, in which, the heating elements have a long life.

With the foregoing and other objects in view, there is provided, in accordance with the invention, a heater for a washer-dryer having a duct in which heating elements are disposed to heat the air flowing through the duct and a device is provided for increasing the air flow in the area of a heating element in the duct. Such a device for increasing the airflow in the area of a heating element makes it possible to avoid local overheating at points on a heating element. It is, thus, possible to increase the life of the heating element because overheating of the heating element is avoided. Furthermore, the avoidance of overheating on a heating element also ensures reliable operation of the heater. Any devices that increase the air mass flow in the area of a heating element may be used as the device for increasing the airflow. These include, in particular, devices for increasing the flow velocity of the air in the area of the heating element.

It is particularly advantageous to configure the device for increasing the airflow as an air guidance element, which guides the air to the heating element and/or increases the flow velocity in the area of the heating element. In such a case, an air guidance element may, advantageously, be configured as a convex projection that extends into the duct and can be disposed upstream of a heating element and/or at the same level, that is to say, close to a heating element, and/or downstream of a heating element on the wall of the duct, thus making it possible to restrict the free flow cross-section in the duct at the location of the projection. Such a configuration makes is possible to achieve a higher airflow velocity adjacent to the projection so that the heating element that is adjacent to the projection can be cooled better.

Such air guidance elements in the form of a projection may also be disposed at two opposite positions within the duct, adjacent to a heating element.

In accordance with another feature of the invention, the air guidance element is at least one pair of air guidance elements disposed at two opposing positions in the duct.

In accordance with a further feature of the invention, the duct has at least one wall, the at least one heating element is linear and extends transversely with respect to an air flow direction in the duct, and the projection is a wall extending transversely with respect to the air flow direction and being disposed on the wall of the duct.

If the heating element is linear and extends transversely with respect to the flow direction in the duct, for example, as in the case of a helical heating element, then the projection that is in the form of an air guidance element likewise extends linearly parallel to the linear heating element.

If a large number of heating elements are disposed one behind the other in the duct of a heater, then the devices for increasing the air flow are provided, in particular, for the downstream heating elements because air that has already been preheated arrives at the downstream heating elements and can, thus, dissipate less heat from the heating elements/heating filaments. This is because the temperature difference between the air and the heating filaments is less. The duct is, advantageously, in the form of a housing, and has a housing with a U-shaped cross-section and a cover that is mounted on the U-shaped housing section. In such a case, the projections may be mounted on the housing section as additional components, for example, walls composed of thin sheet metal, or may be formed integrally in the housing wall, by a shaping process.

In accordance with an added feature of the invention, the housing has a housing wall thickness, the duct has at least one wall, the at least one heating element is linear and extends transversely with respect to an air flow direction in the duct, and the projection is a wall extending transversely with respect to the air flow direction, having a thickness no greater than the housing wall thickness, and being disposed on the wall of the duct.

In accordance with an additional feature of the invention, the duct has a cross-sectional shape selected from at least one of the group consisting of round, square, and rectangular.

In accordance with yet another feature of the invention, a large number of heating elements are disposed one behind the other in the flow direction in the duct, with at least one projection being provided adjacent to a heating element. The projections are configured to be increasingly higher downstream so that the free flow cross-section in the duct becomes smaller in a preferred manner at a projection in the flow direction. This allows the heat to be dissipated even better from heating elements that are disposed further downstream.

In accordance with yet a further feature of the invention, the at least one heating element is a heating filament disposed transversely with respect to an airflow direction in the duct.

In accordance with yet an added feature of the invention, the duct is a housing having a housing section with a U-shaped cross-section and a cover closing the U-shaped housing section.

In accordance with yet an additional feature of the invention, the at least one heating element is a plurality of heating elements disposed one behind another in the duct with respect to an air flow direction, projections are disposed respectively adjacent one of the heating elements, and the projections are increasingly higher in a downstream direction with respect to the air flow to decrease a free flow cross-section in the duct at a given projection in the flow direction.

In accordance with again another feature of the invention, the at least one heating element is a plurality of heating elements.

With the objects of the invention in view, there is also provided a heater for a washer-dryer, including at least one heating element, a heater housing defining a duct in which the at least one heating element is disposed for heating air flowing through the duct, the duct having a wall, and a flow device at the heater housing for increasing air flow in an area of the at least one heating element in the duct, the flow device being a plurality of convex projections on the wall of the duct extending into the duct and being disposed upstream of the at least one heating element with respect to a flow direction of the air, adjacent the at least one heating element, and/or downstream of the at least one heating element with respect to the air flow direction.

With the objects of the invention in view, there is also provided a heater for a washer-dryer, including at least one heating element, and a heater housing defining a duct in which the at least one heating element is disposed for heating air flowing through the duct, the housing having a means for increasing air flow in an area of the at least one heating element in the duct.

With the objects of the invention in view, in a washer-dryer, there is also provided a heater assembly including at least one heating element and a heater housing defining a duct in which the at least one heating element is disposed for heating air flowing through the duct, the housing having a flow device for increasing air flow in an area of the at least one heating element in the duct.

Other features that are considered as characteristic for the invention are set forth in the appended claims.

Although the invention is illustrated and described herein as embodied in a heater for a washer-dryer, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
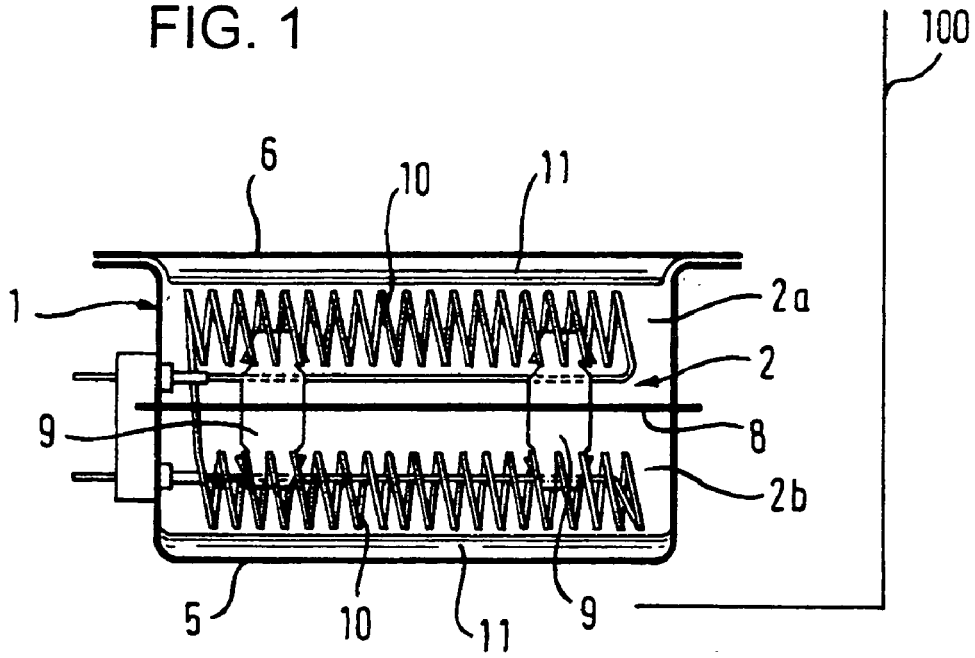
FIG. 1 is a cross-sectional view of a heater for a washer-dryer in a direction transverse to a flow direction.
Figure 2:
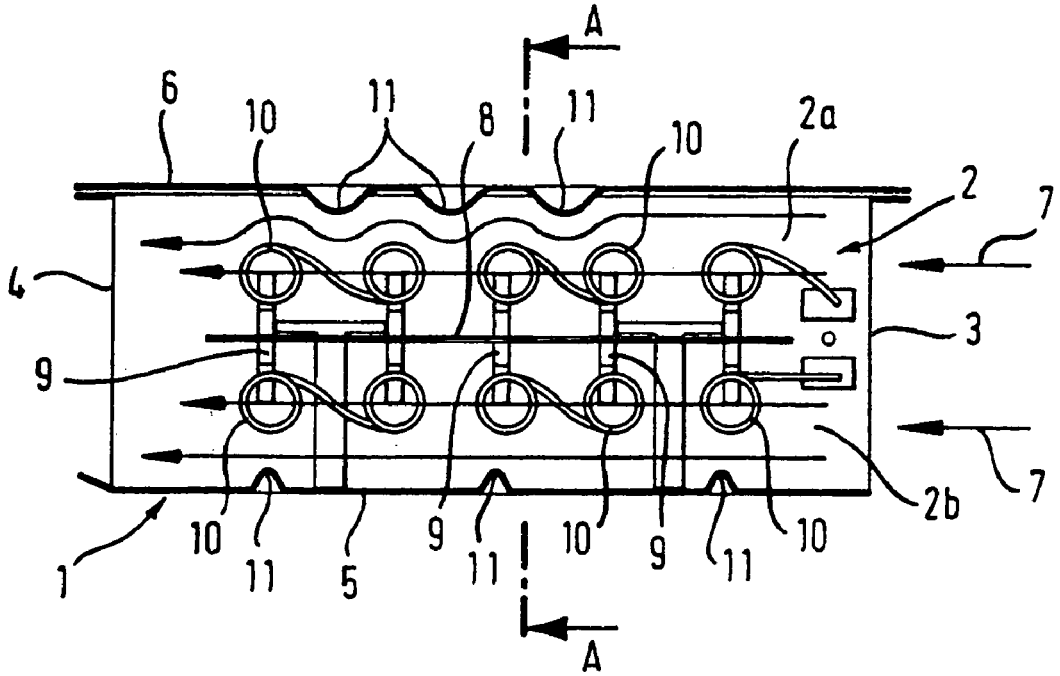
FIG. 2 is a cross-sectional view longitudinally through a first embodiment of a heater for a washer-dryer.

Referring now to the figures of the drawings in detail and first, particularly to FIGS. 1 to 5 thereof, there are shown a heater that can, preferably, be used in a washer-dryer 100. The heater has a housing 1, which is in the form of a duct 2 with an inlet opening 3 for air and an outlet opening 4 for air. The housing 1 has a housing section 5 with a U-shaped cross-section, which is closed by a cover 6. A central wall 8 is disposed in a central section of the U-shaped housing, longitudinally with respect to the flow direction 7. Mounts 9 are attached to the central wall 8, on which heating filaments 10 that are used as heating elements are disposed. The duct 2 is subdivided by the central wall 8 into an upper duct element 2*a* and a lower duct element 2*b*, which have approximately the same dimensions.

A large number of heating filaments 10, which are in the form of heating elements, are disposed at uniform distances one behind the other in the flow direction 7 in each duct element 2*a*, 2*b*.

As is shown in FIGS. 2 to 5, projections 11 are disposed in the cover 6, in each case in a space between two heating filaments 10. These projections 11 are used as air guidance elements to increase the airflow in the area of a heating element. A projection 11 extends linearly over the entire width of the duct. The projections 11, on one hand, increase the transverse flows (vortex component and turbulence) as well as the flow velocity in the flow direction 7 in the area of the heating filament 10 that is located downstream from a projection 11.

Instead of a projection 11 extending linearly over the entire width, a projection 11 may also be interrupted, by which a large number of point projections 11 are provided alongside one another in the width extent of the duct 2 between two heating filaments 10. A projection 11 is, preferably, produced by stamping or thermoforming of the cover 6, of the central wall 8, or of the base section of the U-shaped housing section 5.

Figure 3:
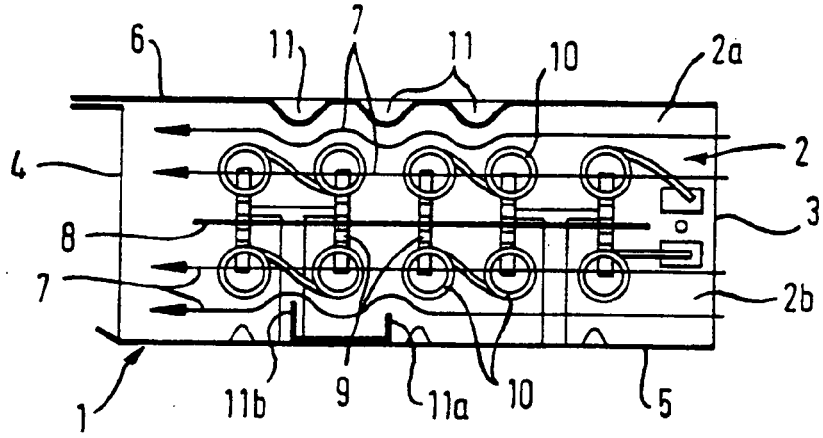
FIG. 3 is a cross-sectional view longitudinally through a second embodiment of a heater for a washer-dryer.

As is shown in FIG. 3, a projection may also be in the form of a U-shaped sheet-metal strip with a first, upstream limb 11*a* and a second, downstream limb 11*b*, with the second limb 11*b* being higher than the first limb 11*a*. The U-shaped sheet-metal strip is, in such a case, disposed such that the limbs 11*a* and 11*b* are disposed in the space between two heating filaments.

Figure 4:
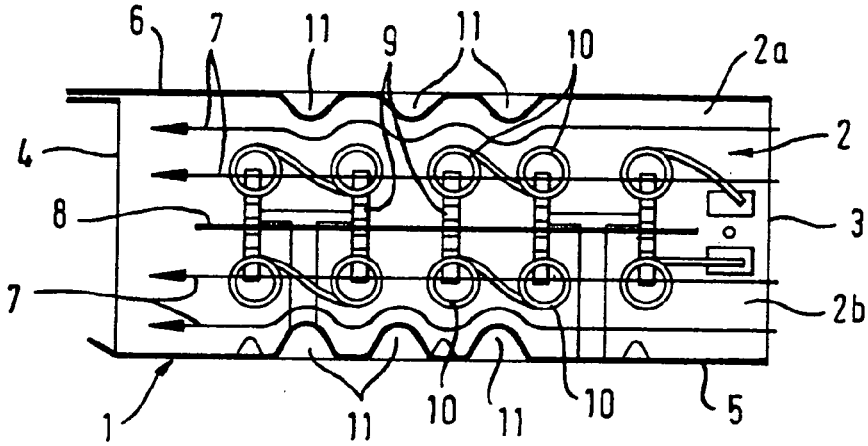
FIG. 4 is a cross-sectional view longitudinally through a third embodiment of a heater for a washer-dryer.

The projections 11 are, preferably, provided between the downstream heating filaments 10 because, downstream from the inlet opening 3, the air has already been heated after passing over the upstream heating filaments, thus, it can absorb less heat from the downstream heating filaments 10 due to the lower temperature gradient between the downstream heating filaments and the air. The projection may also be in the form of a large number of protrusions, as shown in FIG. 4.

Figure 5:
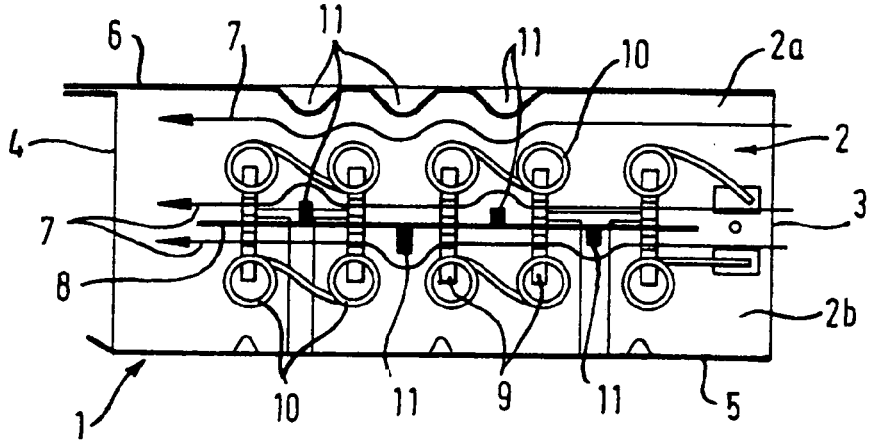
FIG. 5 is a cross-sectional view longitudinally through a fourth embodiment of a heater for a washer-dryer.

As is shown in FIG. 5, projections 11 may also be in the form of rectangular blocks 11 (e.g., of sheet-metal separate from or integral with the central wall 8). The blocks can be, in such a case, disposed such that they are between respective heating filaments, or between every other heating element on each side of the central wall 8 as shown in FIG. 5.

Figure 6:
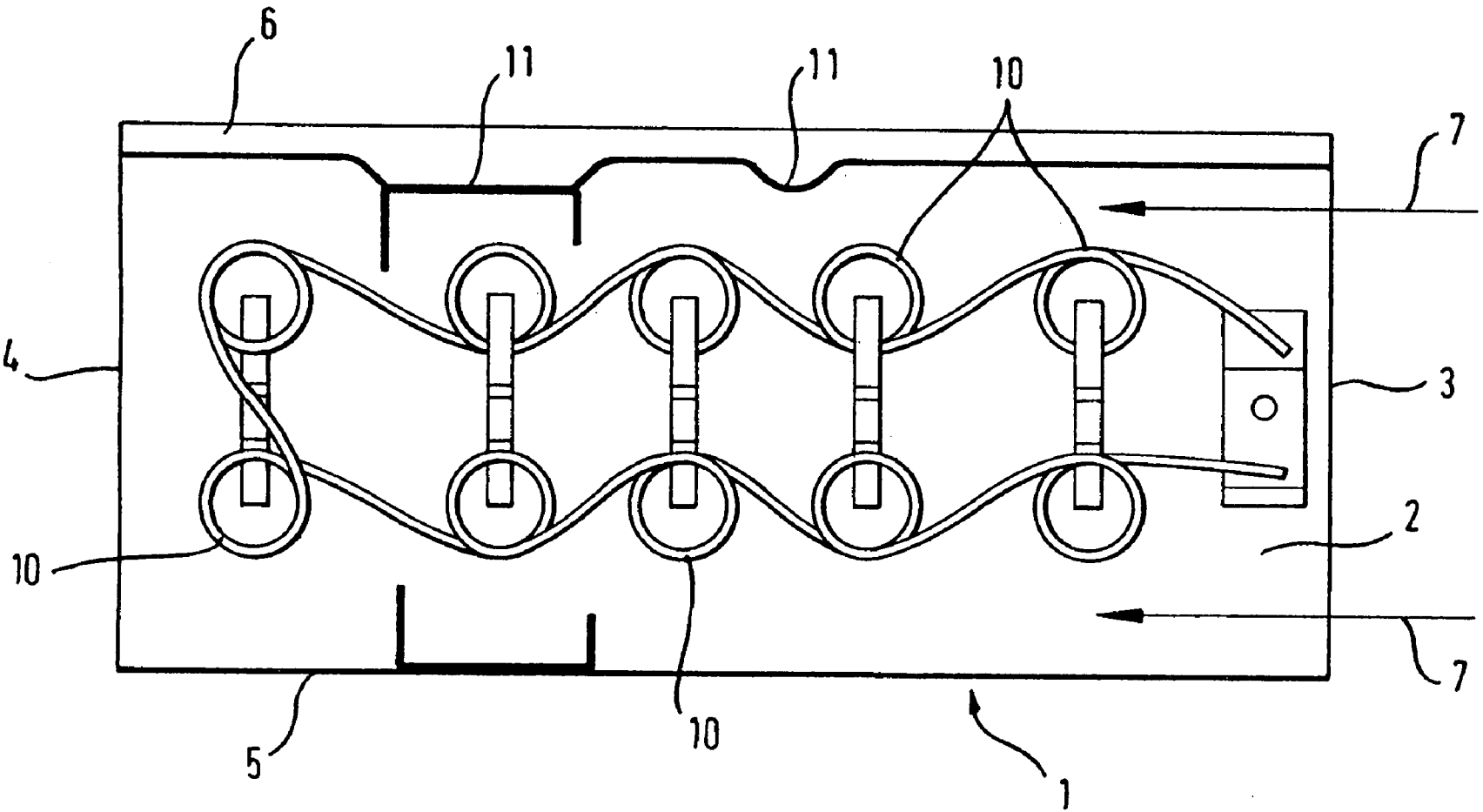
FIG. 6 is a cross-sectional view longitudinally through a fifth embodiment of a heater for a washer-dryer.

As is shown in FIG. 6, five heating filaments 10 are disposed one behind the other in two planes in the flow direction, with the heating filaments 10 being closer to one another in a central section of the duct 2, than they are to the inlet opening 3 and to the outlet opening 4. A first projection 11 is formed in the cover 6 after the second heating filament 10 and projects into the space between the second and third heating filaments 10. Further downstream, a trapezoidal projection 11 is formed in the cover, and extends over the entire fourth heating filament. An additional projection formed from a U-shaped sheet-metal strip is disposed on the trapezoidal projection 11, as has already been illustrated in FIG. 3. Opposite the trapezoidal projection 11, a further U-shaped sheet-metal strip is disposed in the base section of the U-shaped housing section 5, and covers the fourth heating filament in the lower plane. The projections 11 are disposed by experiments so as to eliminate excessively hot areas of the heating filaments.

Instead of configuring the projections 11 between two heating filaments 11 spaced apart one after the other, it is also possible to dispose a projection 11 at the same level as or close to a heating filament so that it is possible to make use of a certain Venturi effect to increase the velocity of the air adjacent to the heating filament.

The provision of a device for increasing the air flow in the area of a heating element considerably increases the life of the heater because the temperature load on the wire of a heating filament 10 can be kept below the critical temperature at which the components may be damaged.

The duct 2 may have a round, square, or rectangular cross-section.

This application claims the priority, under 35 U.S.C. § 119, of German patent application No. 103 26 550.3, filed Jun. 12, 2003; the entire disclosure of the prior application is herewith incorporated by reference.

We claim:

1. A heater for a clothes dryer, comprising:

at least one heating element;

a heater housing defining a duct in which said at least one heating element is disposed for heating air flowing through said duct, said housing having a flow device for increasing air flow in an area of said at least one heating element in said duct;

said at least one heating element is a plurality of heating elements disposed one behind another in said duct with respect to an air flow direction;

projections are disposed respectively adjacent one of said heating elements; and said projections are increasingly higher in a downstream direction with respect to the airflow to decrease a free flow cross-section in said duct at a given projection in said flow direction.

2. The device according to claim 1, wherein:

said duct has at least one wall;

said at least one heating element is linear and extends transversely with respect to an air flow direction in said duct; and said projection is a wall extending transversely with respect to said air flow direction and being disposed on said wall of said duct.

3. The device according to claim 1, wherein said at least one heating element is a heating filament disposed transversely with respect to an airflow direction in said duct.

4. The device according to claim 1, wherein said duct is a housing having:

a housing section with a U-shaped cross-section; and a cover closing said U-shaped housing section.

5. A heater for a clothes dryer, comprising:

a heater housing having a duct defining an air passageway;

multiple heating elements disposed within the duct and heating air flowing through the duct, at least one of the multiple heating elements extending in a direction substantially transverse to the direction of air flow through the duct;

multiple projections extending inwardly from walls of the duct adjacent the heating elements, the projections directing air flow toward the heating elements and increasing air flow velocity near the heating elements; and wherein the duct includes a central wall disposed within the duct and extending in a direction substantially longitudinally to the direction of air flow through the duct, the central wall being disposed between heating elements.

6. The heater according to claim 5, wherein the central wall includes central projections extending outwardly and directing air flow towards the heating elements and increasing air flow velocity near the heating elements.

* * * * *